US009428300B2

(12) United States Patent
Sharp

(10) Patent No.: US 9,428,300 B2
(45) Date of Patent: Aug. 30, 2016

(54) FOLDABLE BOX TEMPLATE WITH INTERNAL GLUE FLAP

(71) Applicant: Packsize LLC, Salt Lake City, UT (US)

(72) Inventor: Tyler Sharp, Orem, UT (US)

(73) Assignee: Packsize LLC, Salt Lake City, UT (US)

( * ) Notice: Subject to any disclaimer, the term of this patent is extended or adjusted under 35 U.S.C. 154(b) by 18 days.

(21) Appl. No.: 14/812,478

(22) Filed: Jul. 29, 2015

(65) Prior Publication Data

US 2016/0039560 A1 Feb. 11, 2016

Related U.S. Application Data

(60) Provisional application No. 62/034,984, filed on Aug. 8, 2014.

(51) Int. Cl.

| | |
|---|---|
| ***B65D 5/44*** | (2006.01) |
| ***B65D 5/42*** | (2006.01) |
| ***B31B 1/26*** | (2006.01) |
| ***B65D 5/02*** | (2006.01) |

(52) U.S. Cl.

CPC ..... *B65D 5/4266* (2013.01); *B31B 1/26* (2013.01); *B65D 5/0227* (2013.01); *B65D 5/0236* (2013.01)

(58) Field of Classification Search

CPC B65D 5/0227; B65D 5/0236; B65D 5/4266; B65D 5/0005

USPC ..... 229/132, 136, 190, 198.2, 915, 918, 229/919, 101

See application file for complete search history.

(56) References Cited

U.S. PATENT DOCUMENTS

| | | | | |
|---|---|---|---|---|
| 2,317,773 A * | 4/1943 | Kavanaugh | B65D 5/0227 | 229/132 |
| 2,594,156 A * | 4/1952 | Reynolds | B65D 5/0227 | 229/121 |
| 3,101,886 A | 8/1963 | Ring | | |
| 3,124,294 A * | 3/1964 | Zerlin | B65D 5/067 | 229/122.21 |
| 3,197,112 A * | 7/1965 | Meyer-Jagenberg | B65D 5/067 | 229/101 |
| 3,672,558 A * | 6/1972 | Johnson | B65D 5/0005 | 229/101 |
| 3,695,508 A * | 10/1972 | Hocking | B65D 5/0005 | 206/806 |
| 3,908,888 A * | 9/1975 | Gordon | B65D 5/3607 | 229/190 |
| 4,094,458 A * | 6/1978 | Nelson, Jr. | B65D 5/3628 | 229/117 |
| 4,874,125 A * | 10/1989 | Bates | B65D 5/443 | 229/132 |
| 6,059,178 A * | 5/2000 | Malloy | B65D 55/024 | 229/102 |
| 2003/0197051 A1 | 10/2003 | Muise et al. | | |
| 2012/0329627 A1 | 12/2012 | Pettersson et al. | | |

FOREIGN PATENT DOCUMENTS

WO 2013103722 7/2013

OTHER PUBLICATIONS

International Search Report and Written Opinion for PCT/US2015/043657 dated Oct. 16, 2015.

* cited by examiner

*Primary Examiner* — Gary Elkins
(74) *Attorney, Agent, or Firm* — Workman Nydegger

(57) ABSTRACT

A foldable box template includes first, second, third, fourth, and fifth segments. Each of the segments has a length, a width, and one or more flaps. The first segment is positioned at a first end of the template and the fifth segment is positioned at a second, opposing end of the template. The first and third segments are each divided into two subsections by an intermediate crease. The intermediate creases facilitate folding of the foldable box template during the creation of a manufacturer's joint.

23 Claims, 6 Drawing Sheets

FOLDABLE BOX TEMPLATE WITH INTERNAL GLUE FLAP

This application claims priority to and the benefit of U.S. Provisional Patent Application No. 62/034,984, filed Aug. 8, 2014, and entitled FOLDABLE BOX TEMPLATE WITH INTERNAL GLUE FLAP, the entire content of which is incorporated herein by this reference.

BACKGROUND

1. Technical Field

Exemplary embodiments of the disclosure relate to packaging. More specifically, embodiments of the disclosure relate to packaging templates that may be assembled into a box with a glue flap thereof positioned on the interior of the assembled box.

2. The Relevant Technology

In many industries, packaging materials are used to deliver products to clients. Often such packaging materials take the form of boxes which the products are place in for delivery. Such boxes may, of course, be of virtually any size and configuration. It may be that the product is placed directly inside the box without any additional protection. In other cases there may be some additional protection or cushioning provided. For instance, foam peanuts, bags of air, bubble-wrap, and the like may be used to protect a fragile or other product.

When an item is placed directly inside of a box, care is often taken to select a box that has dimensions that generally correspond to the dimensions of the item being boxed so that the item fits snugly within the box. Such may be desirable to prevent excess movement of the item and, consequently, reduce the shaking or movement of the item therein. The dimensions of standard sized boxes, however, often do not correspond to the size of the items being packaged therein. As a result, the items being packaged routinely do not snugly fit in standard sized boxes. To avoid excessive movement of the packaged items in such cases, additional cushioning is often placed in the box around the item.

Packaging items in boxes that are too large or that require additional cushioning is costly and inefficient. For instance, the additional material used in creating the larger packages and in cushioning items packaged therein increases the cost of packaging the items. Furthermore, storing a large assortment of premade boxes can require significant amounts of storage space that could otherwise be eliminated or more efficiently used. Moreover, packages that are too large for a particular item are more expensive to ship. Shipping prices are often affected by the size of the shipped package, and not just the package. Thus, reducing the size of an item's package can reduce the price of shipping the item.

To avoid such costs and inefficiencies, systems have been developed for creating custom sized boxes. Such systems create templates out of a planar material which may be folded to form boxes. The templates include sections that, when folded, form the sidewalls of the box. The templates also include flaps that, when folded, form the tops and bottoms of the boxes.

Prior to assembling such a template into a box, opposing sidewall sections are attached together to hold the template in a generally rectangularly shaped tube. The opposing sidewall sections are attached to one another via a glue flap. The glue flap is often integrally formed with and extends from one of the sidewall sections. Glue is applied to the glue flap and/or the opposing side wall section and the glue flap is secured to the opposing sidewall section. The glue is then allowed to set, after which the template may be arranged into a box shape, filled, and shipped.

Although the above-described custom sized boxes may reduce some of the costs and inefficiencies associated with using standard sized boxes, there are still some inefficiencies associated with these custom sized boxes that may be addressed.

BRIEF SUMMARY

This disclosure relates to foldable templates and methods for making custom sized boxes therefrom. More specifically, the disclosure relates to foldable box templates that include glue flaps that may be positioned on the interior of an assembled box and which may be custom sized according to a particular need.

In one embodiment, a foldable template for forming a box includes first, second, third, fourth, and fifth primary segments. The first primary segment is disposed at a first end of the template and has a length, a width, one or more flaps, and a first intermediate crease that divides the first primary segment into first and second subsections along the length of the first primary segment. The second primary segment has a length, a width, and one or more flaps. The third primary segment has a length, a width, one or more flaps, and a second intermediate crease that divides the third primary segment into third and fourth subsections along the length of the third primary segment. The fourth primary segment has a length, a width, and one or more flaps. The fifth primary segment is disposed at a second end of the template opposite to the first segment and has a length and a width.

In another embodiment, a foldable box includes a top surface and a bottom surface, which are formed, respectively, by opposing first and second top flaps and opposing first and second bottom flaps. The foldable box also includes four sidewalls extending between the top and bottom surfaces. A first intermediate crease extends across the first top flap, a first sidewall, and the first bottom flap. A second intermediate crease extends across the second top flap, a second sidewall opposite the first sidewall, and the second bottom flap.

Yet another embodiment includes a method for making a box. The method includes providing a foldable box template that includes five primary segments. Each primary segment has a length, a width, and one or more flaps. Two of the primary segments have intermediate creases that subdivide each of the two primary segments into two subsections along the lengths of the two primary segments. The method also includes folding the foldable box template along one of the intermediate creases and folding the foldable box template along the other intermediate crease. Further, the method includes attaching two opposing primary segments together. Still further, the method includes unfolding the foldable box template along the intermediate creases, folding the foldable box template along the creases between the five primary segments to form four sidewalls, and folding the one or more flaps of the five primary segments to form top and bottom surface of the box.

In yet a further embodiment, a foldable template for forming a box includes a plurality of identifiable sections that are arranged in first, second, third, fourth, and fifth columns and first, second, and third rows. Each column has a length and each row has a width. The first column, which is disposed at a first end of the template, includes a top flap in the first row, a center section in the second row, a bottom flap in the third row, and an intermediate crease extending through the top flap, the center section, and the bottom flap to subdivide the first column into first and second subsections along the length of the first column. The second column includes a top flap in the first row, a center section in the second row, and a bottom flap in the third row. The third column includes a top flap in the first row, a center section in the second row, a bottom flap in the third row, and an intermediate crease extending through the top flap, the center section, and the bottom flap to subdivide the third column into first and second subsections along the length of the third column. The fourth column includes a top flap in the first row, a center section in the second row, and a bottom flap in the third row. The fifth column, which is disposed at a second end of the template, includes a top flap in the first row, a center section in the second row, a bottom flap in the third row.

These and other objects and features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Figure 1:
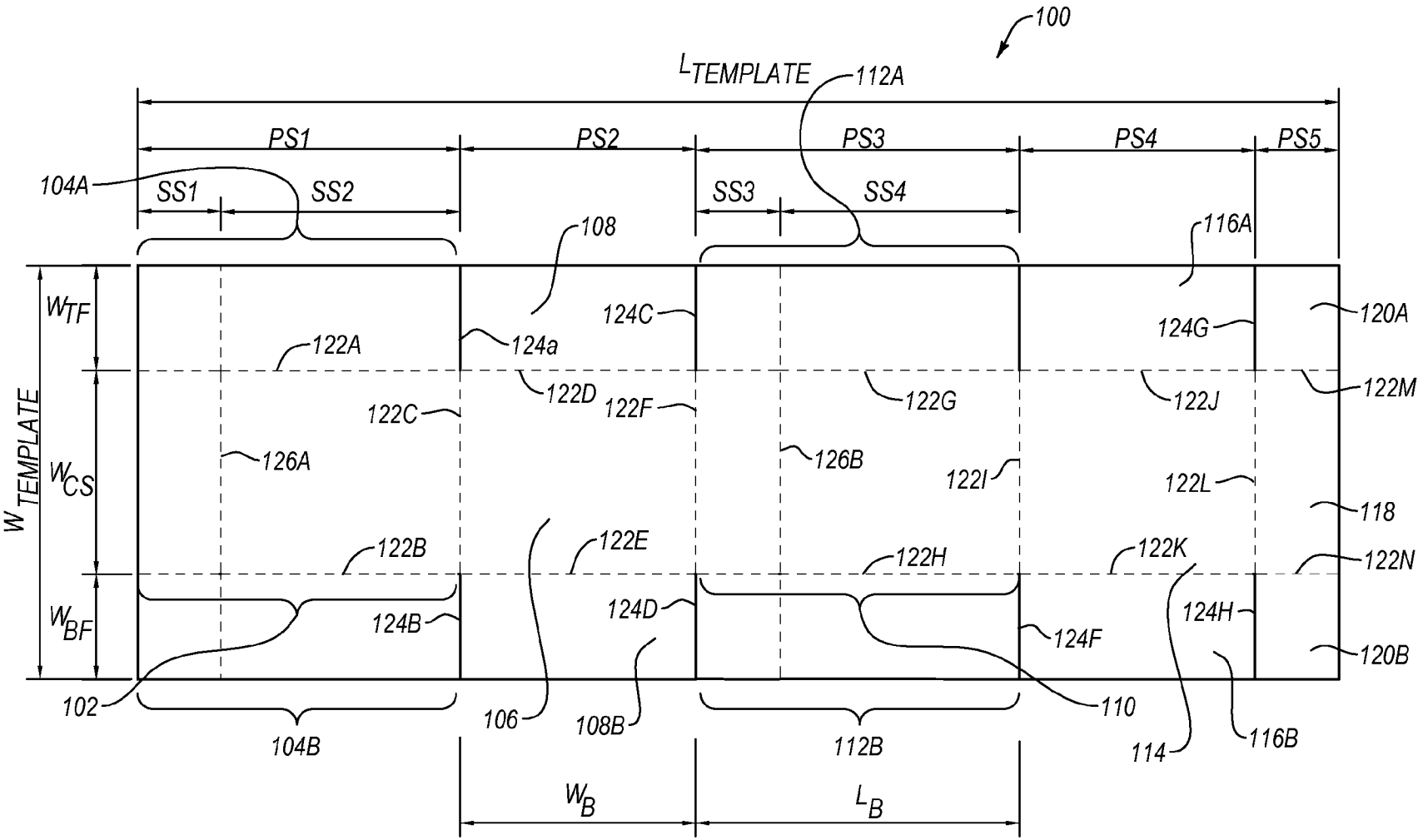
FIG. 1 illustrates a foldable box template according to an exemplary embodiment of the present disclosure.

The embodiments described herein generally relate to a foldable box template that may be arranged into a foldable box with a glue flap thereof positioned in the interior of the assembled box.

As used herein, the term "template" shall refer to a flat stock of material that can be folded into a box. A template may have cuts, notches, cutouts, divides, and/or creases that allow the template to be bent and/or folded into a box. Additionally, a template may be made from any suitable material, generally known to those skilled in the art. For example, cardboard or corrugated paperboard may be used as the template material. Such template materials may have any suitable thickness and weight to permit the template to be bent and/or folded into a box.

As used herein, the term "crease" shall refer to a line along which any portion of the template may be folded. For example, a crease may be an indentation in the template material, which may facilitate the folding of a portion of the template that is adjacent to the crease. A suitable indentation may be created by applying sufficient pressure to reduce the thickness of the material in the desired location and/or by removing some of the material along the desired location, such as by scoring.

The terms "notch," "cutout," and "cut" are used interchangeably herein and shall refer to a shape made by removing material from the template or by separating portions of the template material, such that an incision is made through the template.

While the present disclosure will be described in detail with reference to specific configurations, the descriptions are illustrative and are not to be construed as limiting the disclosure. Various modifications can be made to the illustrated configurations without departing from the spirit and scope of the invention as defined by the claims. For better understanding, like components have been designated by like reference numbers throughout the various accompanying figures.

All creases are identified on the figures with broken lines, and all notches or cuts are identified with bold/solid lines. Although specific creases and specific notches are identified with element numbers 122A-122N, 126A-126B, and 124A-124H, respectively, when a reference is made to a crease or a notch generally, such crease or a notch is identified with respective element number 122, 126, or 124. Additionally, some flaps are designated as "top" flaps and are identified with a letter "A" following the flap element number; other flaps are designated as "bottom" flaps and are identified with a letter "B" following the flap element number. The "top" and "bottom" designations are arbitrary and made for descriptive purposes only. Accordingly, a described "top flap" may be considered a "bottom flap," a "top surface" may be considered a "bottom surface" or a side surface, and vice versa. Similarly, the terms "length," "width," and "height" are chosen arbitrarily. Thus, a described "length" may be considered a width or a height, a described "width" may be considered a length or a height, and a described "height" may be considered a length or a width. Such designations are not intended to represent or connote any specific orientation or location of the box template, its components, or a box formed therewith.

FIG. 1 illustrates an exemplary embodiment of a foldable box template 100. The foldable box template 100 may have a substantially rectangular shape and may comprise five primary segments or columns. A first primary segment 1 (identified as PS1) includes a first center section 102, opposing top and bottom flaps 104A, 104B, and is defined in part by a length. A second primary segment 2 (identified as PS2) includes a second center section 106, opposing top and bottom flaps 108A, 108B, and is defined in part by a length. A third primary segment 3 (identified as PS3) includes a third center section 110, opposing top and bottom flaps 112A, 112B, and is defined in part by a length. A fourth primary segment 4 (identified as PS4) includes a fourth center section 114, opposing top and bottom flaps 116A, 116B, and is defined in part by a length. A fifth primary segment 5 (identified as PS5) includes a fifth center section 118, and optional opposing top and bottom flaps 120A, 120B, and is defined in part by a length. The sum of the lengths of the primary segments PS1, PS2, PS3, PS4, and PS5 may be equal to the length of the template $L_{template}$.

As also illustrated in FIG. 1, the top flaps, the center sections, and the bottom flaps of the foldable box template 100 are arranged in rows. More specifically, the top flaps 104A, 108A, 112A, 116A, 120A form a first row, the center sections 102, 106, 110, 114, 118 form a second or center row, and the bottom flaps 104B, 108B, 112B, 116B, 120B form a third row. The widths of each row can vary from one embodiment to another. For instance, the width(s) of the first and/or third rows (top and bottom flaps) can vary depending on the style of closure desired for the box (e.g., flaps that form half of the top/bottom surfaces of the box, overlapping flaps, etc.). Similarly, although not illustrated, some embodiments of the foldable box template may omit some of the top and/or bottom flaps. For instance, some embodiments of the foldable box template may omit top and bottom flaps 120A, 120B. In other embodiments, all of the top flaps may be omitted in order to use the box template to form a box with an open top. In still other embodiments, alternate flaps may be omitted (e.g., tops flaps 108A, 116A and bottom flaps 108B, 116B).

In the illustrated embodiment, each of primary segments PS1-PS5 is defined by a width, which is the sum of the widths of the top flaps $W_{TF}$, the bottom flaps $W_{BF}$, and the center sections $W_{CS}$ for each respective primary segment. For instance, the width of primary segment PS1 is the sum of the widths of center section 102, top flap 104A, and bottom flap 104B. In the illustrated embodiment, the widths of each of the primary segments PS1-PS5 are substantially equal to one another and to the width of the template $W_{template}$. In other embodiments, however, some primary segments may have widths greater or less than the widths of other primary segments and/or the width of the template $W_{template}$. For instance, the width of one primary segment may be wider or narrower than another primary segment as a result of having wider or narrower top and/or bottom flaps.

Each center section and/or opposing flaps of a primary segment may have substantially rectangular shapes and may be defined by one or more creases, cuts, and/or edges of the foldable box template 100. The center sections may be defined by creases 122 and, for the center sections 102 and 118, which are disposed on opposing ends of the foldable box template 100, by an edge of the foldable box template 100. The flaps may be defined by creases 122, cuts 124, and one or more edges of the foldable box template 100. The creases 122 and cuts 124 may facilitate the folding of adjacent sections relative to one another in order to form a box from box template 100.

More specifically, center section 102 of first primary segment PS1 is defined by creases 122A, 122B, 122C, and an edge of box template 100. Crease 122A separates center section 102 from top flap 104A, crease 122B separates center section 102 from bottom flap 104B, and crease 122C separates center section 102 from center section 106 of second primary segment PS2. Cut 124A separates top flap 104A from top flap 108A of primary segment PS2 and cut 124B separates bottom flap 104B from bottom flap 108B of primary segment PS2.

Center section 106 of second primary segment PS2 is defined by creases 122C, 122D, 122E, and 122F. As noted, crease 122C separates center section 106 from center section 102 of primary segment PS1. Additionally, crease 122D separates center section 106 from top flap 108A, crease 122E separates center section 106 from bottom flap 108B, and crease 122F separates center section 106 from center section 110 of third primary segment PS3. As noted, cuts 124A, 124B separate top and bottom flaps 108A, 108B, respectively, from top and bottom flaps 104A, 104B of primary segment PS1. Further, cut 124C separates top flap 108A from top flap 112A of primary segment PS3 and cut 124D separates bottom flap 108B from bottom flap 112B of primary segment PS3.

Center section 110 of third primary segment PS3 is defined by creases 122F, 122G, 122H, and 122I. As noted, crease 122F separates center section 110 from center section 106 of primary segment PS2. Additionally, crease 122G separates center section 110 from top flap 112A, crease 122H separates center section 110 from bottom flap 112B, and crease 122I separates center section 110 from center section 114 of fourth primary segment PS4. As noted, cuts 124C, 124D separate top and bottom flaps 112A, 112B, respectively, from top and bottom flaps 108A, 108B of primary segment PS2. Further, cuts 124E, 124F separate top and bottom flaps 112A, 112B, respectively, from top and bottom flaps 116A, 116B of primary segment PS4.

Center section 114 of fourth primary segment PS4 is defined by creases 122I, 122J, 122K, and 122L. As noted, crease 122I separates center section 114 from center section 110 of primary segment PS3. Additionally, crease 122J separates center section 114 from top flap 116A, crease 122K separates center section 114 from bottom flap 116B, and crease 122L separates center section 114 from center section 118 of fifth primary segment PS5. As noted, cuts 124E, 124F separate top and bottom flaps 116A, 116B, respectively, from top and bottom flaps 112A, 112B of primary segment PS3. Further, cuts 124G, 124H separate top and bottom flaps 116A, 116B, respectively, from top and bottom flaps 120A, 120B of primary segment PS5.

Finally, center section 118 of the fifth primary segment PS5 is defined by creases 122L, 122M, 122N, and an edge of box template 100. As noted, crease 122L separates center section 118 from center section 114 of primary segment PS4. Additionally, crease 122M separates center section 118 from top flap 120A and crease 122N separates center section 118 from bottom flap 120B. As discussed herein, the fifth primary segment PS5, or at least the center section 118 thereof, may act as or be considered a glue flap be it can be glued or otherwise attached to the first primary segment when constructing a box from the foldable box template 100.

As shown in FIG. 1, the first primary segment PS1 and the fifth primary segment PS5 are disposed at opposite ends of the foldable box template 100. The second primary segment PS2 is disposed between the first primary segment PS1 and the third primary segment PS3. The fourth primary segment PS4 is disposed between the third primary segment PS3 and the fifth primary segment PS5.

In addition to the creases 122 and cuts 124 that at least partially define the center sections, the top and bottom flaps, and the primary segments, the foldable box template 100 also includes intermediate creases 126A, 126B. The intermediate creases 126A, 126B subdivide the first primary segment PS1 and the third primary segment PS3 into subsections. As discussed in detail below, the intermediate creases 126A, 126B facilitate folding of the foldable box template 100 during the assembly of the foldable box template 100 into a box.

As shown in FIG. 1, the intermediate crease 126A extends through the first primary segment PS1 to divide the first primary segment PS1 into a first subjection 1 (identified as SS1) and a second subsection (identified as SS2). The first subjection SS1 and the second subsection SS2 each have a length. Similarly, the intermediate crease 126B extends through the third primary segment PS3 to divide the third primary segment PS3 into a third subjection 3 (identified as SS3) and a fourth subsection (identified as SS4). The third subjection SS3 and the fourth subsection SS4 each have a length.

Following is a brief discussion of various dimensional relationships between the primary segments and the subsections. Although specific relationships will be discussed, it will be understood that these relationships are merely exemplary, and that foldable box templates according to the present disclosure may have dimensional relationships that are different than the exemplary relationships described below.

In some implementations, including the embodiment illustrated in FIG. 1, the foldable box template 100 may be folded to form a generally rectangular box in which the opposing sides of the box have dimensions that are generally equal to one another. For instance, when the foldable box template 100 is folded into a box, center sections 102 and 110 form opposing side surfaces of the box. In order for the resulting box to be generally rectangular in shape, center sections 102 and 110 may be formed with similar or identical dimensions. By way of example, the length the first primary segment PS1 (and/or corresponding center section 102) may be generally equal to the length of the third primary segment PS3 (and/or corresponding center section 110). Accordingly, forming the first and third primary segments PS1, PS3 (and/or corresponding center sections 102, 110) with lengths that are generally equal to one another allows for the resulting box to have a generally uniform length. In other words, the lengths of the first and third primary segments PS1, PS3 (and/or corresponding center sections 102, 110) may be generally equal to one another and may be the length $L_B$ of a box formed from the foldable box template 100. Nevertheless, in other implementations, the lengths of the first and third primary segments PS1, PS3 (and/or corresponding center sections 102, 110) may be different from one another.

Like the center sections 102, 110, the center sections 106, 114 form opposing side surfaces of the box. In order for the resulting box to be generally rectangular in shape, center sections 106, 114 may be formed with similar or identical dimensions. By way of example, the lengths of the second and fourth primary segments PS2, PS4 (and/or corresponding center sections 106, 114) may be generally equal to one another. Accordingly, forming the second and fourth primary segments PS2, PS4 (and/or corresponding center sections 106, 114) with lengths that are generally equal to one another allows for the resulting box to have a generally uniform width. In other words, the lengths of the second and fourth primary segments PS2, PS4 (and/or corresponding center sections 106, 114) may be generally equal to one another and may be the width $W_B$ of a box formed from the foldable box template 100. Nevertheless, in other implementations, the lengths of the second and fourth primary segments PS2, PS4 (and/or corresponding center sections 106, 114) may be different from one another.

In some implementations, including that shown in FIG. 1, the first and third subsections SS1, SS3 have lengths that are generally equal to one another. In cases where the first and third primary segments PS1, PS3 have generally equal lengths and the first and third subsections SS1, SS3 have generally equal lengths, the second and fourth subsections SS2, SS4 will likewise have lengths that are generally equal to one another. Furthermore, the fifth primary segment PS5 may also have a length that is generally equal to the length of one or both of the first and/or third subsections SS1, SS3.

As noted above, the various flaps and center sections of the foldable box template 100 may be folded along the creases in order to construct a box. FIGS. 2-7 illustrate one exemplary method or sequence of steps for constructing a box from the foldable box template 100. It will be understood that the follow description is an exemplary method for constructing a box using the foldable box template 100 and is not intended to limit the disclosure. Other methods may be used to create box using the foldable box template 100 without departing from the spirit of this disclosure.

In describing the process of forming a box from the foldable box template 100, the designations "top surface," "bottom surface," and "sidewalls" are used only for descriptive purposes. Thus, as noted elsewhere herein, a described "sidewall" may be considered a top or bottom surface, a described "top surface" may be considered a bottom surface or a sidewall, and a described "bottom surface" may be considered a top surface or a sidewall.

Figure 2:
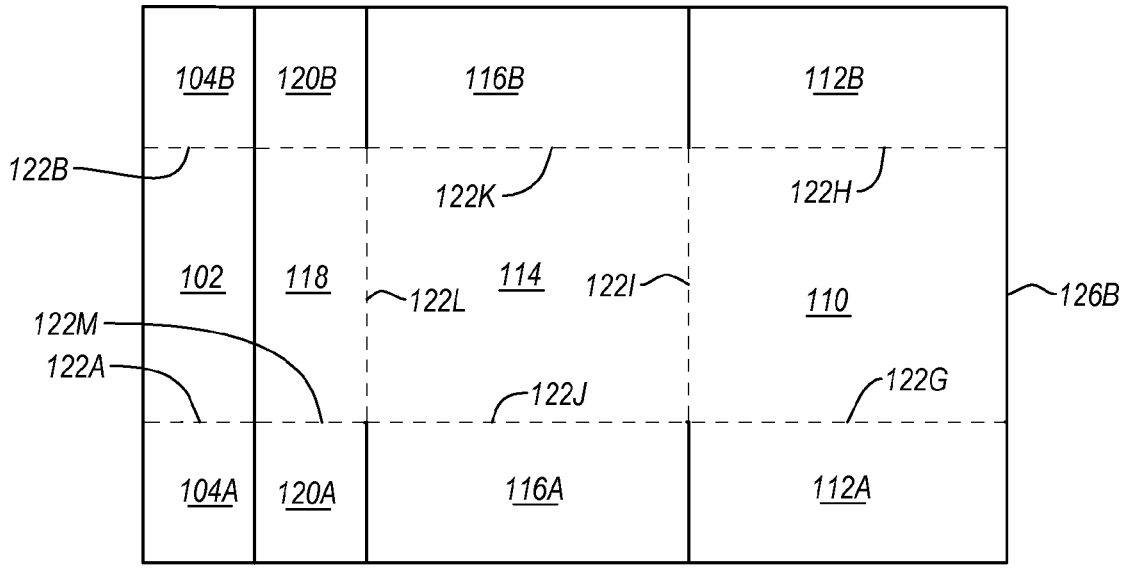
FIG. 2-6 illustrate a method for constructing a box using the foldable box template of FIG. 1.
Figure 3:
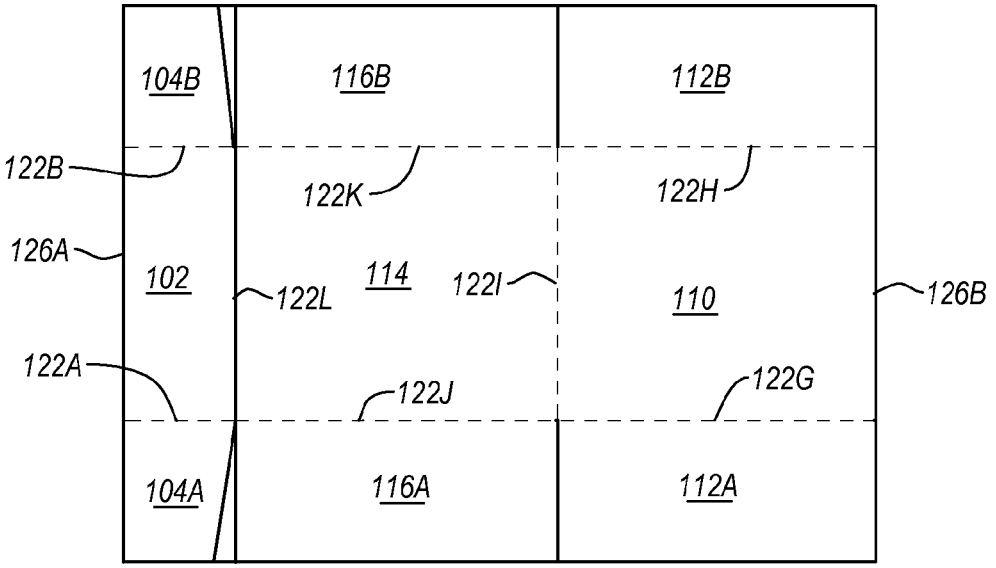

The presently illustrated method starts with creating a "manufacturer's joint." A manufacturer's joint is where opposing ends of the box template are attached to one another so that the template can be arranged in a generally rectangular shaped tube. The creation of the manufacturer's joint according to one exemplary method is illustrated in FIGS. 2-3. The foldable box template 100 may first be folded along intermediate crease 126B so that the foldable box template 100 is arranged as shown in FIG. 2. More specifically, the foldable box template 100 may be folded along intermediate crease 126B so that: (i) the fourth subsection SS4 overlays the third subsection SS3 and a portion of the second primary segment PS2; (ii) the fourth primary segment PS4 overlays portions of the first and second primary segments PS1, PS2 and the crease 122C therebetween; and (iii) the fifth primary segment PS5 overlays a portion of the first primary segment PS1 so that the edge of the fifth primary segment PS5 is positioned adjacent to the crease 126A.

The opposing ends of the foldable box template 100 may be secured to one another to form the manufacturer's joint. For instance, after the foldable box template has been fold into the position shown in FIG. 2, the first primary segment PS1 may be folded and attached to the fifth primary segment PS5. By way of example, and as shown in FIG. 3, glue may be applied between the first and fifth primary segments PS1, PS5 (or to at least one of the first and fifth primary segments PS1, PS5) and the first primary segment PS1, and particularly the first subsection SS1 thereof, may be folded onto the fifth primary segment PS5. For the sake of illustration, FIG. 3 shows the first primary segment PS1 only partially folded onto the fifth primary segment PS5. The first primary segment PS1 may be folded along the crease 126A to position the first subsection SS1 of the first primary segment PS1 on the fifth primary segment PS5. With glue disposed therebetween, the first and fifth primary segments PS1, PS5 may be pressed and/or held together while the glue cures. Once the glue has cured, the manufacturer's joint is complete.

It is of particular note that when forming the manufacturer's joint, the foldable box template 100 is folded along the intermediate creases 126A, 126B and not the creases 122C, 122F, 122I, 122L. As discussed above, the intermediate creases 126A, 126B are used to arrange the foldable box template 100 when forming the manufacturer's joint. As discussed in greater detail below, after formation of the manufacturer's joint, the intermediate creases 126A, 126B are straightened and the creases 122C, 122F, 122I, 122L are used to arrange the foldable box template into a rectangular tube. Thereafter, the top and bottom flaps may be folded to close the box formed with the foldable box template 100.

Figure 4:
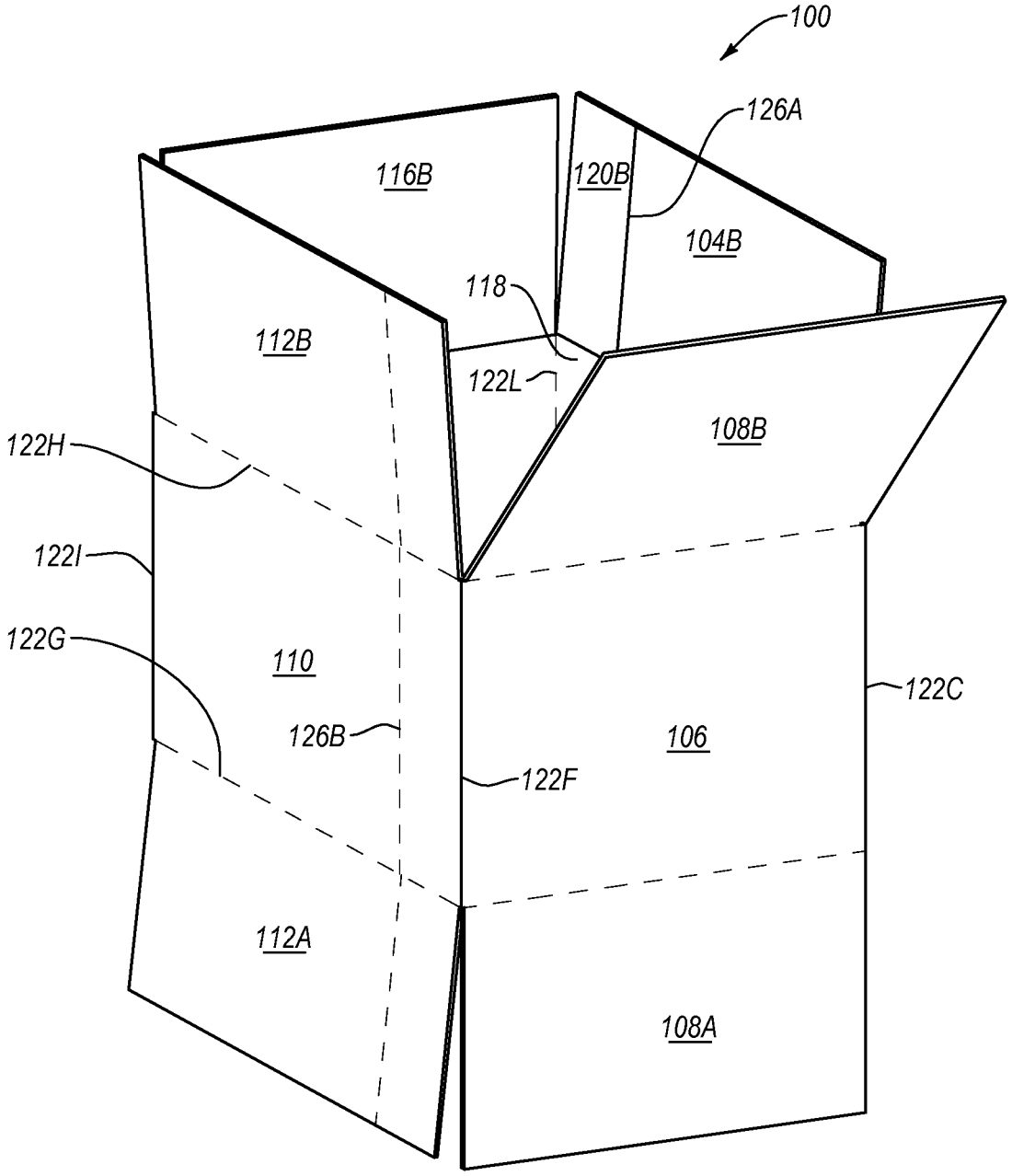

As noted, with the manufacturer's joint formed, the foldable box template 100 can be arranged into a box, as shown in FIGS. 4-7. To erect the foldable box template 100 into a box, the foldable box template 100 is arranged into a generally rectangular tube, as shown in FIG. 4. The foldable box template 100 can be arranged into a rectangular tube by straightening out the intermediate creases 126A, 126B. To straighten the intermediate crease 126A, the first and second subsections SS1, SS2 are moved relative to one another (about the intermediate crease 126A) so that the first and second subsections SS1, SS2 form a generally planar surface. Similarly, to straighten the intermediate crease 126B, the third and fourth subsections SS3, SS4 are moved relative to one another (about the intermediate crease 126B) so that the third and fourth subsections SS3, SS4 form a generally planar surface.

In addition to straightening the intermediate creases 126A, 126B, the foldable box template 100 is also folded along the creases 122C, 122F, 122I, 122L to arrange the foldable box template 100 into a generally rectangular tube. More specifically, as shown in FIG. 4, the first and second primary segments PS1, PS2 are folded about the crease 122C, the second and third primary segments PS2, PS3 are folded about the crease 122F, the third and fourth primary segments PS3, PS4 are folded about the crease 122I, and the fourth and fifth primary segments PS4, PS5 are folded about the crease 122L. In the illustrated embodiment, the primary segments are folded about the creases 122 so that adjacent primary segments form generally right angles. As a result, the foldable box template 100 is arranged in a generally rectangular tube.

As can be seen in FIG. 4, once the foldable box template 100 is arranged into a generally rectangular tube, the first and second subsections SS1, SS2 and the third and fourth subsections SS3, SS4 are no longer folded about the respective intermediate creases 126A, 126B. Additionally, in the illustrated embodiment, the first intermediate crease 126A is positioned on a first side of the rectangular tube (i.e., the side formed by the first primary segment PS1) adjacent a first end of the rectangular tube (i.e., the end formed by the fourth primary segment PS3). Similarly, in the illustrated embodiment, the second intermediate crease 126B is positioned on a second side of the rectangular tube (i.e., the side formed by the third primary segment PS3) adjacent a second end of the rectangular tube (i.e., the end formed by the second primary segment PS2). Thus, in the illustrated embodiment, the first and second intermediate creases 126A, 126B are positioned on opposite sides of the rectangular tube from one another and are adjacent to opposite ends of the rectangular tube.

As can also be seen in FIG. 4, the fifth primary segment PS5 is positioned on the interior of the rectangular tube. That is, the fifth primary segment PS5 is attached to an interior surface of the first primary segment PS1, and more particularly, to an interior surface of the first subsection SS1 thereof. As a result, the fifth primary segment PS5 may act as or be considered a glue flap because it is a relatively small segment that may be attached to an opposing end of the foldable box template 100. Notably, the fifth primary segment PS5 or glue flap is positioned on the interior of the rectangular tube. The interior positioning of the fifth primary segment PS5 will mean that the box formed from the foldable box template 100 will have an interior glue flap, and thus fewer external edges that may be aesthetically undesirable or that could be caught as the box is moved about.

Figure 5:
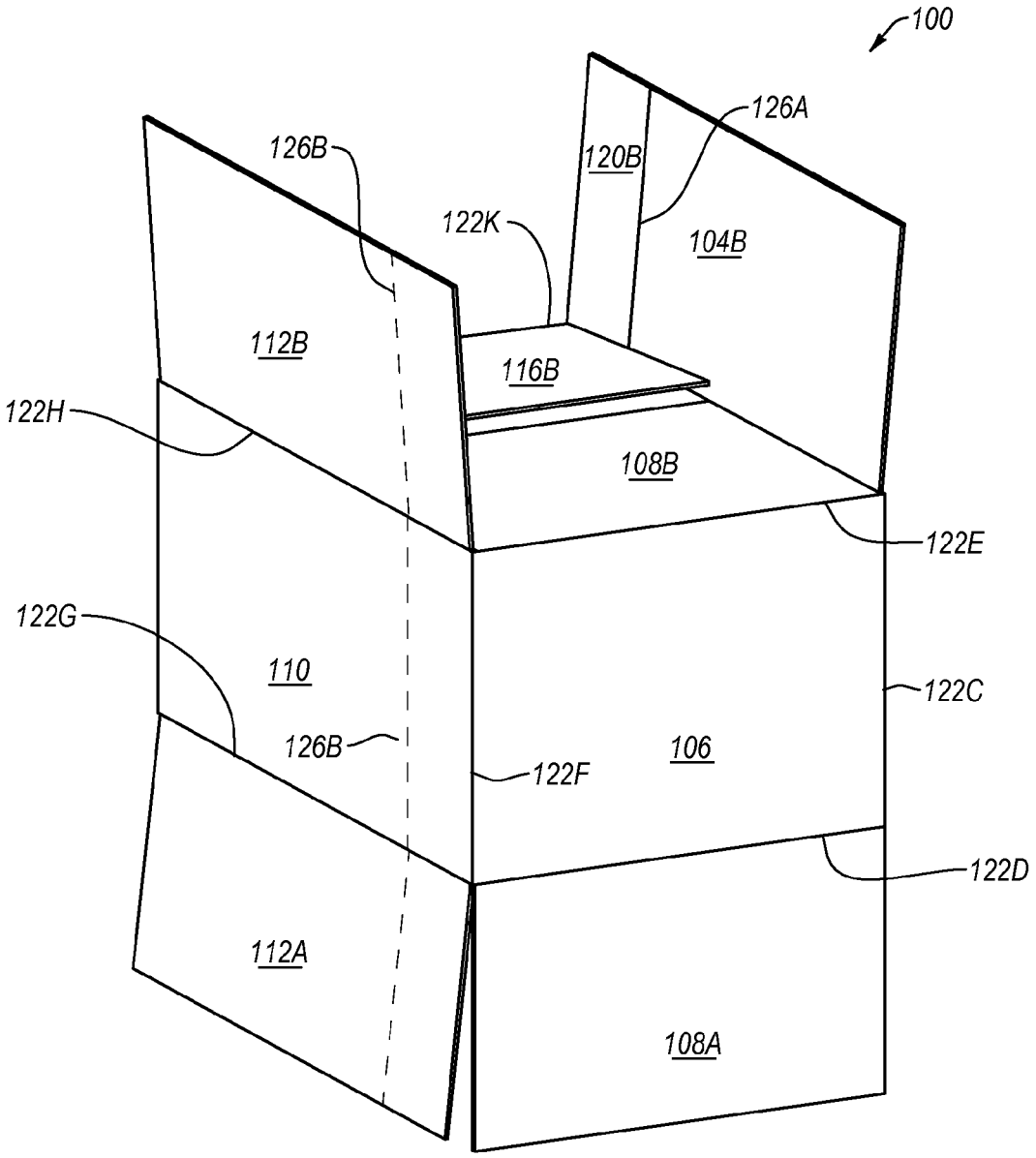
Figure 6:
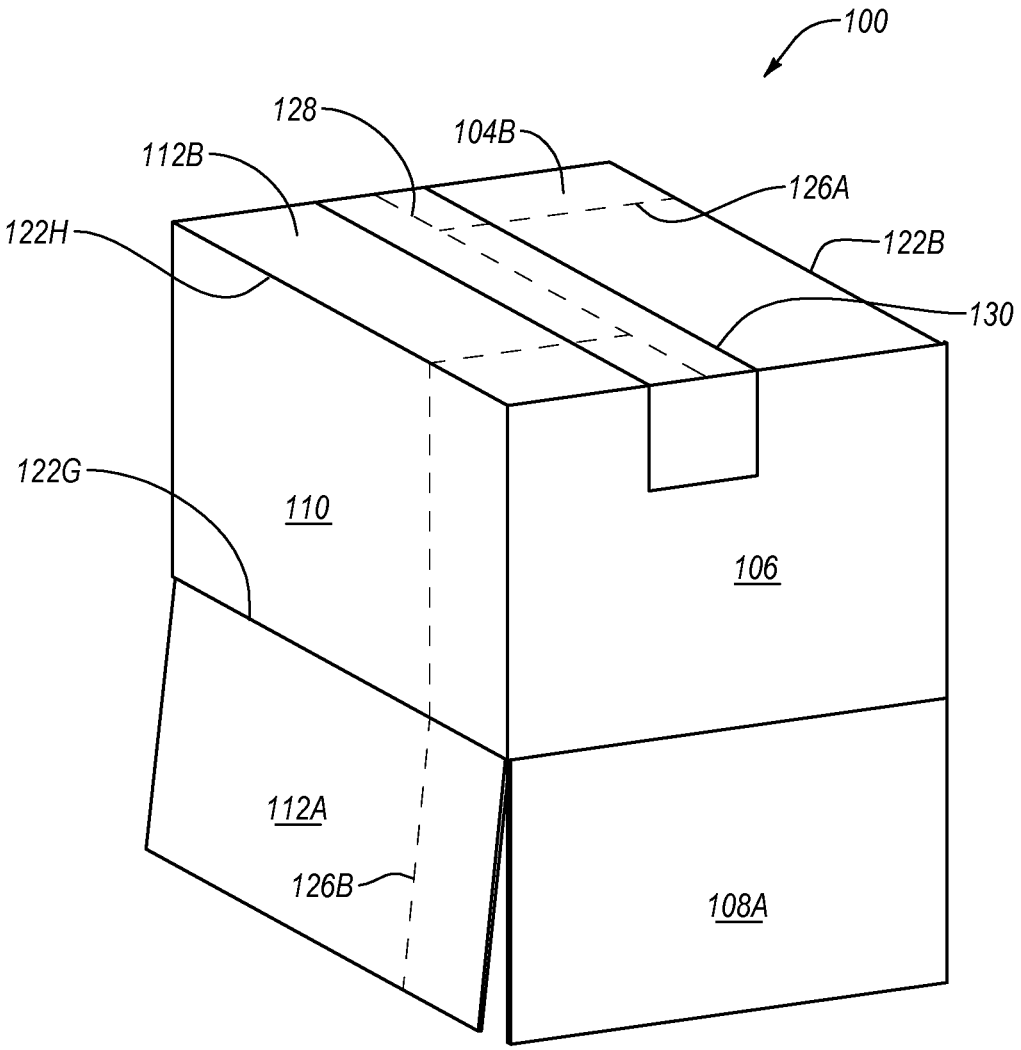
Figure 7:
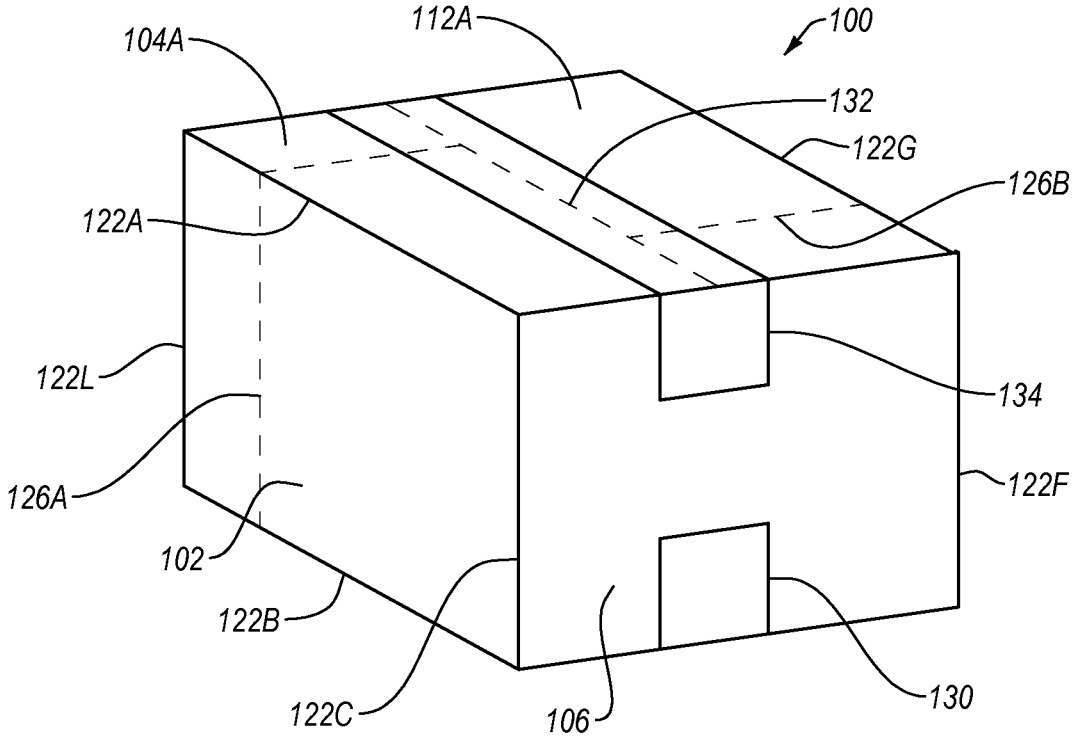
FIG. 7 illustrates a completely folded box constructed from the foldable box template illustrated in FIG. 1.

It is noted that the foldable box template 100 is shown in FIGS. 4-6 with bottom flaps 104B, 108B, 112B, 116B, 120B extending upwardly or positioned on top of the foldable box template 100. This is done to allow for the bottom flaps 104B, 108B, 112B, 116B to be folded closed to create the bottom of a box. Once the bottom of the box is created, the foldable box template 100 may be inverted and filled and the top flaps 104A, 108A, 112A, 116A, 120A may be folded closed and sealed to create the top of the box.

More specifically, as shown in FIG. 5, bottom flap 108B is folded toward the interior of the rectangular tube along crease 122E and bottom flap 116B is likewise folded along crease 122K toward the interior of the rectangular tube. With flaps 108B, 116B folded in, bottom flaps 104B, 112B are then folded toward the interior of the template 100, as shown in FIG. 6. More specifically, bottom flap 104B is folded along crease 122B and bottom flap 112B is folded along crease 122H. When flaps 104B, 112B are so folded, the free ends of flaps 104B, 112B are positioned adjacent to or abut one another, thereby creating a bottom seam 128. Together, flaps 104B, 112B form a bottom surface of the box formed with the foldable box template 100. A piece of tape 130 may then be applied across seam 128 to hold bottom flaps 104B, 112B in place. As shown in FIG. 9, tape 130 may also extend onto the side surfaces of the box formed by center sections 106, 114.

As illustrated in FIG. 6, the first and second intermediate creases 126A, 126B extend across a side surface and a portion of the bottom surface of the box formed with the foldable box template 100. In particular, the first intermediate crease 126A extends across the center section 102 and onto the portion of the bottom surface formed by the flap 104B. Similarly, the second intermediate crease 126B extends across the center section 110 and onto the portion of the bottom surface formed by flap 112B. When the flaps 104B, 112B are folded relative to the center sections 102, 110 as described, the intermediate creases 126A, 126B are provided with added strength. That is, when the flaps 104B, 112B are folded relative to the center sections 102, 110, the intermediate creases 126A, 126B are less likely to fold (or allow the subsections SS1, SS2, SS3, SS4 to fold thereabout).

Once the bottom of the box has been closed as shown in FIG. 6, the partially erected box may be inverted so that top flaps 104A, 108A, 112A, 116A extend upward. The item(s) to be packaged in the box may then be placed therein and the top of the box may be closed. In closing the top of the box, the same process used to close the bottom of the box may be used. That is, top flaps 108A, 116A may be folded in, followed by top flaps 104A, 112A being folded in. Top flaps 104A, 112A may form a seam 132 similar to seam 128. Together, flaps 104A, 112A form a top surface of the box formed with the foldable box template 100. A piece of tape 134 may be applied across seam 132 and, optionally, onto the side surfaces of the box formed by center sections 106, 114.

In light of the disclosure herein, it will be appreciated that the present disclosure extends to various embodiments of box template, boxes, and methods of making boxes from box templates. One example embodiment of a foldable template for forming a box includes first, second, third, fourth, and fifth primary segments. The first primary segment may be disposed at a first end of the template and may have a length, a width, one or more flaps, and a first intermediate crease that divides the first primary segment into first and second subsections along the length of the first primary segment. The second primary segment may have a length, a width, and one or more flaps. The third primary segment may have a length, a width, one or more flaps, and a second intermediate crease that divides the third primary segment into third and fourth subsections along the length of the third primary segment. The fourth primary segment may have a length, a width, and one or more flaps. The fifth primary segment may be disposed at a second end of the template opposite to the first segment and have a length and a width.

In some embodiments, all of the primary segments are aligned along their respective lengths and have substantially the equal widths. In some embodiments, the first intermediate crease extends across the one or more flaps and a center section of the first primary segment. In some embodiments, the second intermediate crease extends across the one or more flaps and a center section of the third primary segment.

In some embodiments, the first intermediate crease and the second intermediate crease are configured to facilitate folding of the template during construction of a box formed with the template.

In another example embodiment, a foldable box includes: a top surface formed by opposing first and second top flaps; a bottom surface formed by opposing first and second bottom flaps; four sidewalls extending between the top and bottom surfaces; a first intermediate crease extending across the first top flap, a first sidewall, and the first bottom flap; and a second intermediate crease extending across the second top flap, a second sidewall opposite the first sidewall, and the second bottom flap. In some embodiments, the first intermediate crease is positioned closer to a third sidewall than a fourth sidewall. In some embodiments, the second intermediate crease is positioned closer to a fourth sidewall than a third sidewall. In some embodiments, the first intermediate crease is offset from the second intermediate crease.

In yet another example embodiment, a method for making a box includes providing a foldable box template having five primary segments separated by creases, each of the primary segments having a length, a width, and one or more flaps, and two of the primary segments having intermediate creases that subdivide each of the two primary segments into two subsections along the lengths of the two primary segments. The method may also include folding the foldable box template along one of the intermediate creases, folding the foldable box template along the other intermediate crease, attaching two opposing primary segments together, unfolding the foldable box template along the intermediate creases, folding the foldable box template along the creases between the five primary segments to form four sidewalls, and folding the one or more flaps of the five primary segments to form top and bottom surface of the box.

In some embodiments, unfolding the foldable box template along the intermediate creases and folding the foldable box template along the creases between the five primary segments to form four sidewalls may be performed substantially simultaneously. In some embodiments, folding the foldable box template along the creases between the five primary segments to form four sidewalls positions the intermediate creases on opposing sides of the box. In some embodiments, the intermediate creases are generally parallel to the creases that separate the five primary segments.

In still yet a further embodiment, a foldable template for forming a box includes a plurality of identifiable sections that are arranged in first, second, third, fourth, and fifth columns and first, second, and third rows, each column having a length and each row having a width. The first column may include a top flap in the first row, a center section in the second row, a bottom flap in the third row, and an intermediate crease extending through the top flap, the center section, and the bottom flap to subdivide the first column into first and second subsections along the length of the first column. The first column may be disposed at a first end of the template. The second column may include a top flap in the first row, a center section in the second row, and a bottom flap in the third row. The third column may include a top flap in the first row, a center section in the second row, a bottom flap in the third row, and an intermediate crease extending through the top flap, the center section, and the bottom flap to subdivide the third column into first and second subsections along the length of the third column. The fourth column may include a top flap in the first row, a center section in the second row, and a bottom flap in the third row. The fifth column may include a top flap in the first row, a center section in the second row, and a bottom flap in the third row. The fifth column may be disposed at a second end of the template opposite the first column.

In some embodiments, top flaps from adjacent columns are separated from one another by a cut. In some embodiments, bottom flaps from adjacent columns are separated from one another by a cut. In some embodiments, center sections from adjacent columns are separated from one another by a crease. In some embodiments, the first and fifth columns may be secured together along the width of the center sections to form a manufacturer's joint of the box. In some embodiments, the first and fifth columns may be secured together along the width of the center sections and along at least portions of widths of the top and/or bottom flaps to form a manufacturer's joint of the box. In some embodiments, the fifth column may be secured to the first subsection of the first column. In some embodiments, the intermediate creases are generally parallel to the first, second, third, fourth, and fifth columns.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A foldable template for forming a box, comprising:

a first primary segment disposed at a first end of the template, the first primary segment having a length, a width, one or more flaps, and a first intermediate crease that divides the first primary segment into a first subsection and a second subsections along the length of the first primary segment, the first subsection being disposed closer to the first end than the second subsection;

a second primary segment having a length, a width, and one or more flaps;

a third primary segment having a length, a width, one or more flaps, and a second intermediate crease that divides the third primary segment into a third subsection and a fourth subsection along the length of the third primary segment;

a fourth primary segment having a length, a width, and one or more flaps; and a fifth primary segment disposed at a second end of the template opposite to the first segment, the fifth segment having a length and a width, the length of the fifth primary segment being substantially equal to a length of the first subsection.

2. The foldable template of claim 1, wherein all of the primary segments are aligned along their respective lengths and have substantially equal widths.

3. The foldable template of claim 1, wherein each primary segment has a center section, a top flap, and a bottom flap, wherein the top and bottom flaps extend from opposing sides of the center sections.

4. The foldable template of claim 1, wherein at least one of:

the second primary segment is disposed between the first primary segment and the third primary segment;

the third primary segment is disposed between the second primary segment and the fourth primary segment; and the fourth primary segment is disposed between the third primary segment and the fifth primary segment.

5. The foldable template of claim 1, wherein the length of the fifth primary segment is substantially equal to a length of the third subsection of the third primary segment.

6. The foldable template of claim 1, wherein the foldable template is made of cardboard.

7. The foldable template of claim 1, wherein at least one of:

the first intermediate crease extends across the one or more flaps and a center section of the first primary segment; and the second intermediate crease extends across the one or more flaps and a center section of the third primary segment.

8. The foldable template of claim 1, wherein the first intermediate crease and the second intermediate crease are configured to facilitate folding of the template during construction of a box formed with the template.

9. A foldable box, comprising:

a top surface formed by a first top flap and an opposing second top flap;

a bottom surface formed by a first bottom flap and an opposing second bottom flap;

four sidewalls extending between the top surface and the bottom surface;

a first intermediate crease extending across the first top flap, a first sidewall, and the first bottom flap, the first intermediate crease being unfolded along a width of the first sidewall; and a second intermediate crease extending across the second top flap, a second sidewall opposite the first sidewall, and the second bottom flap, the second intermediate crease being unfolded along a width of the second sidewall, and the second intermediate crease being offset from the first intermediate crease.

10. The foldable box of claim 9, wherein at least one of:

the first intermediate crease is positioned closer to a third sidewall than a fourth sidewall; and the second intermediate crease is positioned closer to the fourth sidewall than the third sidewall.

11. The foldable box of claim 9, further comprising an internal glue flap that connects two of the four sidewalls together.

12. A method of making a box, comprising:

providing a foldable box template having first, second, third, fourth, and fifth primary segments separated by creases, each of the primary segments having a length, a width, and one or more flaps, and each of the first primary segment and the third primary segment having an intermediate crease that subdivides each of the first primary segment and the third primary segment into two subsections along the lengths of the first primary segment and the third primary segment;

folding the foldable box template along the intermediate crease of the third primary segment, such that the fifth primary segment overlies a portion of the first primary segment;

while the intermediate crease of the third primary segment is still folded, folding the foldable box template along the intermediate crease of the first primary segment, such that a portion of the first primary segment overlies the fifth primary segment;

after folding the foldable box template along the intermediate crease of the first primary segment, attaching the first primary segment to either the fourth primary segment or the fifth primary segment;

unfolding the foldable box template along the intermediate creases;

folding the foldable box template along the creases between the primary segments to form four sidewalls; and folding the one or more flaps of the primary segments to form top and bottom surfaces of the box.

13. The method of claim 12, further comprising securing the one or more flaps forming the top surface and the bottom surface.

14. The method of claim 12, wherein unfolding the foldable box template along the intermediate creases and folding the foldable box template along the creases between the primary segments to form four sidewalls are performed substantially simultaneously.

15. The method of claim 12, wherein folding the foldable box template along the creases between the primary segments to form four sidewalls positions the intermediate creases on opposing sides of the box.

16. A foldable template for forming a box, comprising:

a plurality of identifiable sections that are arranged in first, second, third, fourth, and fifth columns and first, second, and third rows, each column having a length and each row having a width, the first column including a top flap in the first row, a center section in the second row, a bottom flap in the third row, and an intermediate crease extending through the top flap, the center section, and the bottom flap to subdivide the first column into a first subsection and a second subsections along the length of the first column, the first column being disposed at a first end of the template;

the second column including a top flap in the first row, a center section in the second row, and a bottom flap in the third row;

the third column including a top flap in the first row, a center section in the second row, a bottom flap in the third row, and an intermediate crease extending through the top flap, the center section, and the bottom flap to subdivide the third column into a first subsection and a second subsection along the length of the third column;

the fourth column including a top flap in the first row, a center section in the second row, and a bottom flap in the third row; and the fifth column including a top flap in the first row, a center section in the second row, and a bottom flap in the third row, the fifth column being disposed at a second end of the template opposite the first column, the length of the fifth column being substantially equal to a length of the first subsection of the first column.

17. The foldable template of claim 16, wherein at least one of:

the length of the first column is substantially equal to the length of the third column;

the length of the second column is substantially equal to the length of the fourth column; and the length of the fifth column is substantially equal to a length of the first subsection of the third column.

18. The foldable template of claim 16, wherein the second column is between the first column and the third column, the third column is between the second column and the fourth column, and the fourth column is between the third column and the fifth column.

19. The foldable template of claim 16, wherein:

the top flaps from adjacent columns are separated from one another by a cut;

the bottom flaps from the adjacent columns are separated from one another by a cut; and the center sections from the adjacent columns are separated from one another by a crease.

20. The foldable template of claim 16, wherein at least one of:

the first column and the fifth column may be secured together along the width of the center sections thereof to form a manufacturer's joint of the box; and the first column and the fifth column& may be secured together along the width of the center sections thereof and along at least portions of widths of the top flaps and the bottom flap thereof to form a manufacturer's joint of the box.

21. The foldable template of claim 16, wherein the fifth column may be secured to the first subsection of the first column.

22. The foldable template of claim 16, wherein the foldable template may be folded along the intermediate creases during formation of a manufacturer's joint.

23. The foldable template of claim 16, wherein the intermediate creases are generally parallel to the first, second, third, fourth, and fifth columns.

* * * * *